United States Patent [19]

Schweitzer et al.

[11] Patent Number: 4,935,943

[45] Date of Patent: Jun. 19, 1990

[54] CORROSION RESISTANT STORAGE CONTAINER FOR RADIOACTIVE MATERIAL

[75] Inventors: Donald G. Schweitzer, Bayport; Mary S. Davis, Wading River, both of N.Y.

[73] Assignee: The United States of America as represented by the United States Department of Energy, Washington, D.C.

[21] Appl. No.: 645,652

[22] Filed: Aug. 30, 1984

[51] Int. Cl.[5] ..... G21C 19/00; G21F 5/00

[52] U.S. Cl. ..... 376/272; 220/429; 220/448; 250/507.1

[58] Field of Search ..... 376/272; 250/506.1, 250/507.1, 515.1; 220/429, 445, 448

[56] References Cited

U.S. PATENT DOCUMENTS

| | | | |
|---|---|---|---|
| 964,080 | 7/1910 | Wolf | 220/429 |
| 2,783,195 | 2/1957 | Raynes et al. | 220/429 |
| 3,021,273 | 2/1962 | Dix | 376/273 |
| 3,298,185 | 1/1967 | Loudon | 220/429 |
| 3,575,601 | 4/1971 | Lindsay et al. . | |
| 3,588,031 | 6/1971 | Howard et al. | 250/506.1 |
| 3,603,106 | 9/1971 | Ryan et al. | 220/429 |
| 3,754,141 | 8/1973 | Leesl et al. | 250/507.1 |
| 3,780,306 | 12/1973 | Anderson et al. . | |
| 3,780,309 | 12/1973 | Bochard | 250/507.1 |
| 3,845,315 | 10/1974 | Blum . | |
| 3,930,166 | 12/1975 | Bochard . | |
| 4,006,362 | 2/1977 | Mollon et al. . | |
| 4,058,479 | 11/1977 | White et al. . | |
| 4,136,493 | 1/1979 | Bradford et al. | 220/429 |
| 4,562,001 | 12/1985 | Vietzlie et al. | 250/507.1 |

FOREIGN PATENT DOCUMENTS

| | | | |
|---|---|---|---|
| 2824240 | 12/1979 | Fed. Rep. of Germany | 376/272 |
| 3244727 | 6/1984 | Fed. Rep. of Germany | 376/272 |

*Primary Examiner*—Charles T. Jordan
*Assistant Examiner*—Richard W. Wendtland
*Attorney, Agent, or Firm*—Vale P. Myles; James W. Weinberger; William R. Moser

[57] ABSTRACT

A corrosion resistant long-term storage container for isolating radioactive waste material in a repository. The container is formed of a plurality of sealed corrosion resistant canisters of different relative sizes, with the smaller canisters housed within the larger canisters, and with spacer means disposed between judxtaposed pairs of canisters to maintain a predetermined spacing between each of the canisters. The combination of the plural surfaces of the canisters and the associated spacer means is effective to make the container capable of resisting corrosion, and thereby of preventing waste material from leaking from the innermost canister into the ambient atmosphere.

16 Claims, 1 Drawing Sheet

CORROSION RESISTANT STORAGE CONTAINER FOR RADIOACTIVE MATERIAL

The U.S. Government has rights in this invention pursuant to Contract Number DE-AC02-76CH00016, between the U.S. Department of Energy and Associated Universities Inc.

BACKGROUND OF THE INVENTION

The invention relates to a long-term corrosion resistant storage container fabrication for isolating radioactive waste material in a high level waste repository and, more particularly, relates to such a container having a plurality of relatively light weight, thin walled, hermetically sealed canisters mounted within one another in combination with selected spacer means disposed between adjacent canisters to support them in a predetermined spaced relationship. The plurality of canisters and spacer means used to fabricate a container according to the invention are effective to greatly increase the long-term corrosion resistance of the container relative to the corrosion resistance life of other storage containers that may have equal or greater wall thicknesses and greater overall weights in their wall construction materials.

From the time that the first radioactive materials were produced, to the present time, there has existed a desire to develop storage containers in which such materials could be safely deposited until their levels of radioactivity decayed sufficiently to render them safe to handle. As the evolution of nuclear power generating stations occurred, increasingly large volumes of radioactive waste material were produced on an annual basis. Concurrently, operating practices and management guidelines were developed to provide for the safe handling, short-term storage, and long term disposition of these large volumes of so-called radwaste materials. In general, under such practices and guidelines, different procedures were developed for handling both relatively low level radioactive materials, and high level radioactive materials.

A primary codification of the guidelines that has been developed in the United States for handling such radwaste materials is set forth in the U.S. Code of Federal Regulations. Specifically, 10 CFR, Part 60 sets forth the Nuclear Regulatory Commission's criteria and guidelines for storing high level radwaste materials in multiple-layer containers that must be sufficiently resistant to corrosion to prevent the containers from leaking for a minimum period of 300 years. 10 CFR, Part 61 sets forth the NRC licensing requirements and criteria for disposing of relatively low level radwaste materials in shallow sand disposal sites. Such relatively low level radwaste materials should be completely contained in high integrity waste containers that have as a design goal a life-time of not less than 300 years. The corrosive and chemical effects of both the radwaste contents of the containers and of their environment in a repository will determine their usable life span. Accordingly, suitable tests must be devised for ascertaining the corrosion resistance and chemical characteristics of proposed materials and designs that are to be used in making such containers.

The present invention is useful in manufacturing corrosion resistant storage containers for safely isolating high level radwaste material in compliance with the requirements of 10 CFR 60, i.e., for making containers that resist corrosion sufficiently to prevent leakage from the containers for 300 years. Because the repositories in which such containers may be stored might include environments that contain water or other corrosion facilitating liquids, the container constructions of the invention are selected to maximize the corrosion slowing or inhibiting effect by requiring successive initiation of corrosion on sequentially spaced surfaces of the canisters making up the container. In other words, because corrosion of most metals is slow to initiate on a metal surface, but then proceeds rapidly through the sub-surface portions of the metal, one principle of the present invention is to force corrosive materials to sequentially encounter a series of separate surfaces upon which corrosion must be independently initiated. A second principal of the invention is to maximize the dilution or weakening of the corrosive effect of liquids or other contaminants as they penetrate the outer canisters and spacer means of the container, so that the corrosive effect of such penetrating contaminants on the inner canisters of the container is minimized or nearly neutralized. The combined effect of these principles is that containers made in accordance with the invention have desirably non-linear rates of corrosion. The existing laws regulating the isolation and disposal of high level radioactive wastes make it necessary to extrapolate data from relatively short-term corrosion rate tests to predict corrosion rates for periods up to 1000 years with reasonable assurance of the accuracy of the predictions. To provide such reasonable assurances, the extrapolation methods should be conservative. A linear extrapolation of corrosion rates for a container would be conservative if the container can be shown to have a non-linear and much slower than linear corrosion rate. Thus, the present invention provides a solution to the long standing problem of providing a conservative means for reasonably assuring that short term corrosion rate test data can be used to predict the corrosion rates for containers over anticipated 1000 year life spans.

It is well known in the nuclear industry to provide multiple layered containers for handling radioactive material. Such prior art multiple layer radioactive material containers have generally been designed to provide two basic functions. First, containers having multiple layers of thick metal, concrete or other radiation shielding means are frequently used to protect those handling the containers from the lethal effect of the radiation emitted by the material within the containers. Second, rugged, relatively heavy multiple-layered containers have been so constructed in order to resist the mechanical shocks encountered in shipping radioactive materials. Containers designed for providing those well known, common functions are readily distinguished from the type of thin-walled, light weight plural canister and spacer means construction used in fabricating containers according to the present invention. For example, the heavy shock resistant type of containers used for transporting radioactive material normally contain a number of unsealed joints in their sidewalls which enable the containers to be readily opened for insertion and removal of the shipped contents. In addition to containing such leakage-prone or weakly corrosion-resistant joints, which are typically of a simple step design, such shipping containers normally utilize different materials in the respective multiple layers thereof, so that should corrosion be initiated through the walls of the container an undesirable electrolytic action would readily be established to accelerate the progress of such corrosion through successive layers of the containers. Examples of such prior art multiple layer containers for transporting radioactive materials are shown in U.S. Pat. Nos. 3,575,601—Graham, which issued Apr. 20, 1971; 3,780,306—Anderson, which issued Dec. 18, 1973; 3,845,315—Blum, which issued Oct. 29, 1974; and 3,930,166—Bochard, which issued Dec. 30, 1975.

Examples of the type of prior art multiple layer containers that have been designed primarily for shielding the environment from radiation emitted by the contents of the containers are shown by U.S. Pat. Nos. 3,780,309—Bochard, which issued Dec. 18, 1973; 4,006,362—Mollon, which issued Feb. 1, 1977; and 4,058,479—White, which issued Nov. 15, 1977. The types of containers represented by the last three designated patents utilize successive layers of different materials to increase their radiation shielding effect; however, as pointed out above, it should be recognized that the use of such different materials provides an undesirable corrosion enhancing mechanism due to the establishment of electrolytic cells between the different materials of the container as corrosion introduces electrolytes into contact with the successive layers in the walls of the containers. Moreover, it appears that the types of multiple-walled containers shown by these last three patents are primarily suited for short term storage of relatively low level radwaste materials, rather than being designed to be effective for long term storage of high level radwaste materials. In practice, it is now common to use either 55 gallon carbon steel drums lined with lead or concrete, or to use 30 gallon concrete containers to package low level radwaste materials for disposal in an approved land burial site.

The plural canister container of the present invention is readily distinguished from such known types of shorter-term storage containers for low level radwaste materials, and from the prior art types of multiple-layer shipping containers shown, respectively, in the foregoing patents. For example, the spacer means used in fabricating some preferred embodiments of the containers of the present invention are selected to have interstices and high surface areas that inhibit free flow of corrosion-accelerating liquids between the surfaces of successive canisters within a given container. In addition, diffusion of reactants from the exterior of corroding surfaces of the successive canisters in a container fabricated according to the invention are inhibited by such spacer means disposed between the successive canisters. A further characterizing advantage of the container construction of the present invention is that removal of beneficial corrosion products by free-flowing liquids is prevented, and the formation of local corrosive concentration cells on the surfaces of the canisters of the containers is prevented by the particulate, porous materials used in forming some of the spacer means employed in practicing certain embodiments of the invention.

SUMMARY OF THE INVENTION

In one preferred embodiment of the invention, a corrosion resistant, long-term storage container for isolating high level radioactive waste material is formed by positioning a plurality of sealed corrosion-resistant canisters of different relative sizes within one another, and by disposing spacer means between the juxtaposed canisters to maintain a predetermined, corrosion-inhibiting space between the juxtaposed surfaces of adjacent canisters. In some forms of the invention, all of the canisters in a container are made of essentially the same material in order to prevent electrolytic action from occurring between the canisters responsive to an electrolyte entering the spaces between them. The spacer means used in some embodiments of the invention are made of particulate material that is effective to afford the advantages of; inhibiting free flow of liquids between the canisters, inhibiting diffusion of reactants from the surfaces of the canisters, inhibiting removal of corrosion products from the surfaces of the canisters, and providing large surface areas for adsorbing reactants that may penetrate the outer canisters during the effective lifetime of the container.

OBJECTS OF THE INVENTION

A major object of the invention is to provide a corrosion resistant long-term storage container that is effective to safely contain high level radioactive materials for at least 300 years, and that is made to have a non-linear corrosion rate which enables the container to be made to have a design life that reasonably assures corrosion resistance for up to 1,000 years.

A further object of the invention is to provide such a long-term storage container that is relatively light weight and economical in construction while being fabricated to inhibit corrosion-accelerating stress cracking of the surfaces of the inner canisters used in making the container.

Another object of the invention is to provide a long-term storage container for high level radwaste materials, which container effectively retards or prevents many of the usual corrosion-accelerating mechanisms that are encountered by containers stored in environments that expose the containers to water and other liquid contaminants.

Still another object of the invention is to provide a long-term corrosion resistant radwaste material container that has sufficient radiation stability, corrosion resistance, structural strength, thermal stability and biodegradation resistance to enable it to safely store high level radwaste materials for at least 1,000 years.

Additional objects and advantages of the invention will become apparent to those skilled in the art from the description of it contained herein, considered in conjunction with the illustrations of the accompanying drawing.

DESCRIPTION OF THE PREFERRED EMBODIMENTS

Figure 1:
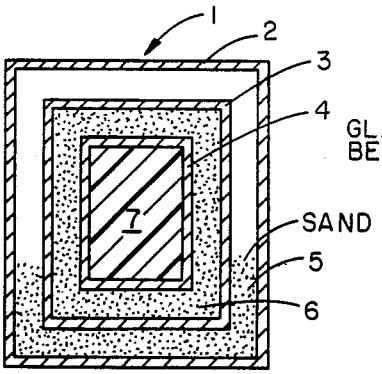
FIG. 1 is a side plan view, in cross section, and not to scale, schematically illustrating a long-term storage container fabricated of a plurality of sealed canisters that are separated by spacer means disposed between the canisters in accordance with the teaching of the present invention.

FIGS. 1 through 4 of the drawing show four different alternative embodiments of corrosion resistant, long-term storage containers that are each constructed according to the present invention. As the description of these various embodiments proceeds, it will be apparent that each of them has characteristic features that makes it particularly suitable for given applications, but it will also be recognized that each of the alternative embodiments incorporates characterizing features of the invention that make all of the containers suitable for accomplishing the above-stated objects of the invention. Although any one of the illustrated embodiments of the invention may be a most preferred embodiment for a given application, it is believed that the particular embodiment of the invention illustrated in FIG. 4 will be found to be a commonly selected best mode for practicing the invention for most long term radwaste storage applications. It will also be apparent to those skilled in the art that certain of the features of the invention described with reference to one or the other of the illustrated embodiments may also be readily incorporated appropriately into various of the other illustrated embodiments in order to achieve certain desired combinations of the characteristic features of the invention, for use in given selected long-term storage applications.

Referring now to FIG. 1 of the drawing, there is illustrated a corrosion resistant long-term storage container 1 that is intended for use in isolating radioactive waste material so that the container can be safely disposed of in a high level waste repository, where the container may be subjected to water or other corrosion enhancing environments. The container 1 is made up of a plurality of sealed corrosion resistant canisters 2, 3 and 4, which are of different relative sizes. The canisters are arranged, as shown, with all of the smaller canisters (3 and 4) encased within the largest canister (2), in said plurality of canisters. As will be more fully explained with reference to FIG. 2, in some embodiments of the containers made in practicing the invention for given storage applications, the plurality of canisters utilized may exceed in number the three canisters used in the embodiment shown in FIG. 1.

In order to hold respective juxtaposed pairs of the canisters in container 1 in spaced relationship to one another, predetermined spacer means 5 and 6 are disposed, respectively, between juxtaposed pairs (2–3 and 3–4) of said canisters. In the embodiment of the invention illustrated in FIG. 1, the spacer means 5 and 6 comprises densely packed particulate material that is arranged in separate batches (5 and 6) that are positioned, respectively, between each of the spaced pairs of canisters, so that the particulate material is made effective to afford the several objectives of the invention outlined above. In particular, in one form of the invention the batches of particulate material each comprise particles of granular material taken from the group comprising sand ($SiO_2$), glass, or ceramic materials. For example, as shown in FIG. 1, both of the batches 5 and 6 are made up of clean sand. Such a construction has been found to afford the following important objectives of the invention: The particles of packed sand constituting the spacer means 5 and 6 in this embodiment of the invention are effective to; inhibit free flow of liquids between the canisters, inhibit diffusion of reactants from the juxtaposed surfaces of the canisters, inhibit removal of corrosion products from the juxtaposed surfaces of the canisters, and to provide large surface areas for adsorbing reactants that penetrate the outer canisters as they become corroded and leak.

It will be apparent that in various alternative arrangements of the spacer means (5 and 6) they can be used to afford either all, or at least a selected number of, the foregoing objectives of the invention. For example, as is further shown by FIG. 1, in some applications of the invention it may be desirable to only partially fill the space between given juxtaposed pairs of the canisters in the container 1. Thus, the space between canisters 2 and 3 is shown in FIG. 1 as being only partially filled by the sand spacer means 5 in this embodiment of the invention. One advantage of such a construction is that the overall weight of container 1 can be significantly reduced by such selective use of spacer means in practicing the invention.

In certain other applications of the invention at least one of the selected batches (5) constituting the spacer means utilized in a given container (1) can be arranged to substantially fill about half the space between a selected pair (2 and 3) of canisters that are juxtaposed with such a relatively small batch of sand or other suitable spacer means. In such a construction of the invention, it will be appreciated that the unfilled portion of the space between such a juxtaposed pair of canisters (2 and 3) constitutes a void area in which all of the foregoing objectives of the spacer means will not be provided. Specifically, in the unfilled space between the canisters 2 and 3 in the container 1 of FIG. 1, should a liquid corrosion medium enter that unfilled space, there would be no particulate material (in the unfilled portion) to inhibit the free flow of such liquid, or to diffuse reactants from the surfaces of the canisters, etc. However, it should be clear that if the container 1 is oriented in the vertical relationship shown in FIG. 1, any such corrosive liquids that might penetrate the largest, outer canister 2 will tend to collect in the sand spacer means 5 near the bottom half of the container, at least until such time as enough liquid has penetrated the outer canister 2 to fill the lower half of it. Thus, such a construction affords most of the objectives of the invention, at least for a portion of the life of the container 1. In addition, as will become apparent from the test results of given prototype embodiments of the invention (such results are shown below), containers made with substantially void spaces between selected juxtaposed pairs of incorporated canisters, have been found to be reasonably effective in providing the long-term corrosion inhibiting results desired from the invention. Accordingly, in applications where consideration such as the cost of manufacture, and the overall weight of the container 1 are important, the use of such partial, or substantially total, voids between selected pairs of canisters within a given container (1) can be successfully employed.

It will also be recognized that while the above-mentioned granular materials for use in making the spacer means are relatively inexpensive and easy to handle, other materials for use as such spacer means (5 and 6) will also afford the desired objectives of the invention, while being more advantageous in terms of extending the effective corrosion resistant life of the container 1. For example, in some embodiments of the invention, the spacer means may all be made of particulate carbon which can be either inserted in powder form, as illustrated generally in FIG. 1, or which may be used in pellet or larger granular form, as will be explained with reference to FIG. 2, or which may be formed as blocks made up of compressed powder or fibers, as illustrated for example in FIG. 3.

When considering such potential alternative arrangements of the materials or configurations of the spacer means (5 and 6) to be selected in making a given container (1), it will be apparent that at least one of the batches of spacer means (5 or 6) of the selected filler material can be made sufficiently small relative to the space that is to be filled, so that the spacer means only partially fills the space between a selected pair of the canisters juxtaposed therewith. In such an arrangement the space between canisters is either more or less than half filled, in the manner described more specifically above. At the same time, it should be obvious that in alternative embodiments the respective batches of particulate material used to make up the spacer means 5 and 6, can be sized to make each batch of spacer means substantially fill, respectively, the space between said juxtaposed pairs of canisters that are in engagement with the respective spacer means. Further, it should be apparent that in other given embodiments of the invention at least one of the batches of material used to make a selected spacer means, can comprise a material that is different than that used in making up the other batches of material used to form the other spacer means in the container (1). For example, in one arrangement of an embodiment such as that shown in FIG. 1, the first spacer means (5) can be made of sand, while the second spacer means (6) can be made of powdered carbon or other alternative material that may be particularly useful in a given application. Of course, it is important to remember in selecting such combinations of different materials, for use as the spacer means of the invention, that care should be taken to avoid the establishment of potentially corrosive electrolytic cells between such disparate materials used for the spacer means.

Figure 2:
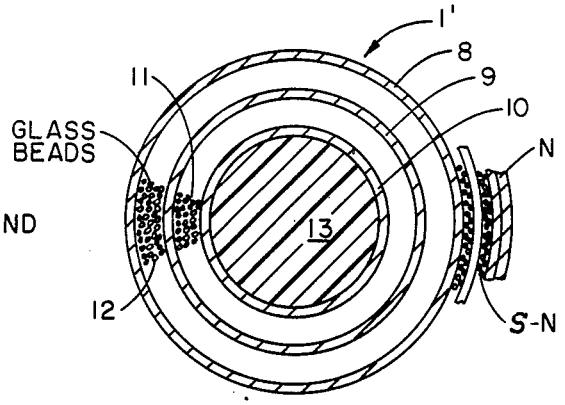
FIG. 2 is a side plan view, in cross section, not to scale, and including a fragmentary portion of an outer canister wall, showing schematically an alternative arrangement of spacer means and canister construction used in making an alternative container fabrication according to the invention.
Figure 3:
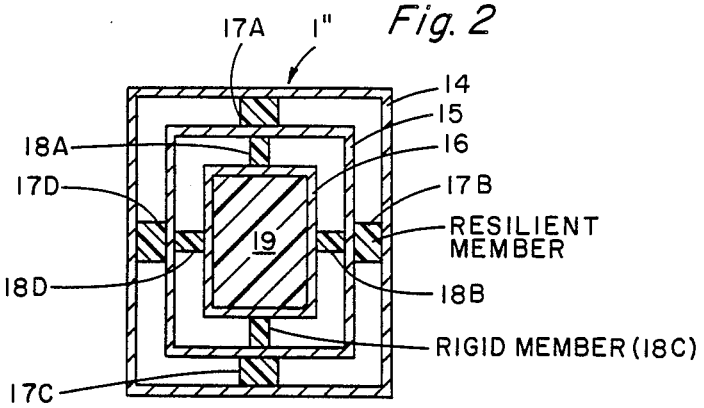
FIG. 3 is a side elevation view, in cross section, and not to scale, schematically showing a plurality of sealed canisters positioned within one another and spaced apart by still another kind of spacer means to form yet another alternative container construction according to the invention.
Figure 4:
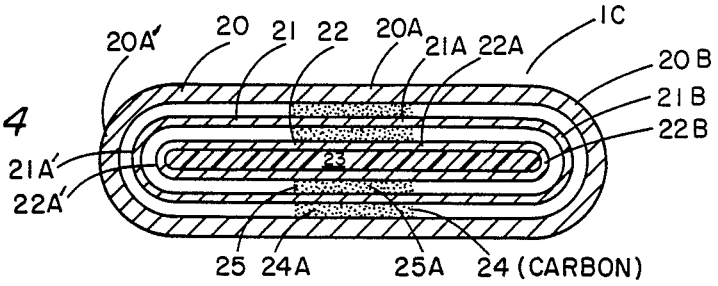
FIG. 4 is a side plan view, in cross section, and not to scale, schematically showing a plurality of sealed canisters, respectively formed of seamless pipes having dome-shaped caps at their opposite ends. The canisters are arranged in combination with spacer means between the canisters for rigidly supporting them against relative movement, in a manner that minimizes the risk of causing stress corrosion cracking of the surfaces of the inner canisters, according to the construction of this further alternative embodiment of a container according to the present invention.

Before proceeding to a description of the other alternative embodiments of the invention, as they are shown in FIGS. 2–4, it should be pointed out that in the embodiment of the container 1 shown in FIG. 1, each of the canisters 2–4 is made of essentially the same kind of material, in order to prevent electrolytic action from occurring between given juxtaposed pairs of the canisters (2–3 or 3–4) in response to an electrolyte material, such as water, entering the space, or spaces between them. In particular, in the most preferred embodiment of the container 1, the material used in making each of the canisters 2–4 is stainless steel that is formed to provide substantially uniform wall thicknesses, as shown, with the thickness of each wall of the respective canisters being in the range of about 0.015 to 0.040 inch. In fact, in a given most preferred embodiment, three stainless steel canisters 2, 3 and 4 are used to form the container 1. Each of those canisters is made of stainless steel having a wall thickness of about 0.018 inch.

Those skilled in the art will recognize that other suitable corrosion resistant materials can be used for making the respective canisters (e.g. 2–4) in alternative embodiments of the container (1). For example, copper or various noble metals, such as gold, platinum, etc. may be used to form one or more of the canisters in a given container 1, for particular applications of the invention. Obviously, if the noble metals are used in practicing the invention, cost considerations will dictate that very thin-walled canisters of such materials be employed. Thus, in given applications of the invention, a canister having a structurally rigid wall of fiberglass or other selected corrosion resistant material may be used to support a thin, continuous layer of gold to form one or more of the inner canisters (e.g. 3 and/or 4) used in making a container 1 of the invention.

As the invention is practiced with different applications individual canister combinations will be appropriately selected for use in different environments and will contain varying and different types of radioactive and/or chemical wastes. Accordingly, for those various applications the materials of the canister walls, their thicknesses, the dimensions of the spaces between them and the chemical, and physical properties of the spacer means or filler materials selected, will be appropriately varied and adjusted to accommodate such variables as:

(a) the heat transfer and thermal conductivity, e.g., when various high level wastes are isolated, (b) controlled release and/or diffusion of certain reactants is required through selected spacer means or fillers that are chosen to have given porosity and permeability characteristics, (c) adsorption or precipitation of waste materials within the spacer regions of the container by selecting the chemical and physical properties of filler materials, such as their surface area and pH.

It will also be apparent that a wide variety of types of radioactive material can be stored in the container 1. For the purpose of completing the description of the embodiment of the invention shown in FIG. 1, it should be noted that there is depicted within the smallest container 4 a body of such an exemplary radwaste material 7. Any suitable waste form may be used to makeup the body of material 7. For example, particulate radwaste material may be encased within low density polyethylene to form monoliths or small pellets, or the radwaste material 7 may contain amounts of liquid contaminants. Also, it will be apparent that the container 1, and the other embodiments of the invention described herein, can be used to provide safe long-term storage for a wide range of toxic materials, which may or may not be radioactive.

Referring now to FIG. 2 of the drawing, another alternative embodiment of the invention will be described. Whereas the canisters 2–4 shown in FIG. 1 were generally cylindrical in configuration, as is partially illustrated in FIG. 1, the container 1′ shown in FIG. 2 is made up of a plurality of canisters 8, 9, 10 and N which may vary in number up to any desired selected number, as is indicated by the break shown between the canister 8 and the outermost canister N. In this form of the invention each of the canisters 8–N is made in a substantially spherical configuration and the spacer means 11, 12 and S–N comprise respective batches of glass beads. Specifically, the glass beads identified as the granular spacer means 12 comprise borosilicate glass beads, each of which are about 4 millimeters in diameter. Thus, the interstices between the glass beads making up the respective spacer means are effective to afford the above mentioned objectives of the invention whereby any liquid that penetrates the outer canisters is inhibited in its free flow and is spread over the large surface areas of the spacer or filler means. In addition, adsorption of reactants in the penetrating liquid occurs in the spacer means.

A further characteristic feature of this embodiment of the invention is that the outermost canister N has a generally uniform wall thickness that is at least about twice as thick as the wall thickness of any of the other canisters (e.g. 8–10) in the plurality of canisters making up the container 1'. The purpose for using such a thicker outer canister N is to provide desirable mechanical rigidity for the container, while enabling the thicknesses of the respective inner canisters 8–10 to be relatively thin and structurally weaker. Thus, the weight of the overall container 1' can be desirably reduced, while still providing a long-term storage container that includes a number of sequentially arranged surfaces that are operable to greatly inhibit the rate at which all of the canisters in the container 1' are corroded to an extent that such a corrosive agent would penetrate into the stored radioactive material 13 within the innermost canister 10.

In addition to providing greater mechanical strength, the relatively thicker walls of outer canister N are thus made more effective to substantially dilute or weaken the corrosive effect of any corroding agents that eventually penetrate through the body of material in its walls. Similarly, as such a corrosive agent continues to penetrate through the successive layers of spacer means S–N, 12 and 11, as well as through the walls of the inner canisters (8, 9 and 10, etc.), each of those penetrated materials acts to further dilute and weaken the corrosive effect of the corroding agent. Accordingly, in addition to the major corrosion inhibiting effect of the plural surfaces afforded by the multiple canisters 8–N of this embodiment of the invention, it should be recognized that partly as a consequence of the above-noted characteristics of the intervening spacer means the rates of corrosion of the innermost canisters (e.g. 9 and 10) will be substantially slower than that of the outer canisters (e.g. N and 8), due to the resultant dilution and weakening of the corroding agents.

Finally, it will be apparent that in making the plurality of canisters 8–N in either this embodiment of the invention, or in the other embodiments of the invention described herein, various means can be used to tightly seal the respective canisters. In the embodiment of the invention shown in FIG. 2, each of the spherically shaped canisters 8–N is made by welding two preformed half-spheres together. It is important to remember that in so forming the canisters, care should be taken to avoid the formation of discontinuities in their outer surfaces. Thus, in the more preferred embodiments of the invention, each of the canisters 8–N will be formed with a polished outer stainless steel surface, so that any welded portions (not shown) do not contain cracks or other discontinuities at their outer surfaces, which cracks might accelerate the rate of corrosion of the canisters. As explained above, an important features of the present invention is to utilize the corrosion inhibiting effect of the plural surfaces provided by the respective canisters used in making a container 1'. Accordingly, the outer surfaces of the respective canister should, most preferably not have any pores or other sharp discontinuities in them, because such discontinuities are known to accelerate the initiation of corrosion on surfaces when they are exposed to corroding agents.

A further alternative embodiment of the invention is illustrated in FIG. 3, as a container 1'' that comprises a plurality of generally rectangularly shaped sealed canisters 14, 15 and 16, which are nested within one another as shown. Rather that using spacer means formed of particulate or granular material, in this embodiment of the invention the spacer means used comprise two sets of blocks 17A–D and 18A–D, which are positioned, respectively, at preselected points to render them effective to maintain a substantially uniform width of the respective spaces defined between the juxtaposed pairs (14–15 and 15–16) of the canisters. The innermost canister 16 houses a body of radwaste material 19 and each of the canisters 14–16 is formed of stainless steel having an average wall thickness of about 0.018 inch. In order to avoid the establishment of corrosion enhancing electrolytic cell activity between either the adjacent canisters, or the blocks 17A–D or 18A–D, all of these blocks are also made of essentially the same material, i.e., stainless steel, as that used in making the canisters. In alternative combinations of the features used in making a container 1'', such as that shown in FIG. 3, it should be recognized that the spacer means comprising the sets of blocks 17A–17D and 18A–18D can be made of a variety of different corrosion resistant materials, which should be selected so that they do not result in the establishment of undesirable electrolytic cells when an electrolyte material penetrates the spaces between the juxtaposed pairs of canisters in the container. Thus, the various blocks can be made of a corrosion resistant dielectric material, such as high density polyethylene.

An advantage of such alternative forms for the blocks, or for the materials used to form such blocks, is that the given sets of blocks constituting the spacer means in such a container 1'' can thus be selectively made of mechanically deformable material that is softer than the stainless steel (or any other relatively more rigid material that may be used to form the respective canisters). By using such relatively more deformable material to make the spacer means, it will be apparent that a desirable cushioning effect is thereby provided for the inner canisters. Consequently, should the container 1'' be subjected to mechanical shocks, such as may result from dropping the container, or from impacting it while it is being handled or stored in a repository, the cushioning effect of the spacer means would prevent stressing, and possible resultant stress cracking of the inner canister surfaces. In a selected alternative embodiment of the invention, one of the sets of spacer means blocks, e.g. block 17A–17D, can be made of a rigid material, such as stainless steel, while the other set of spacer means blocks 18A–18D is made of a more resilient material, such as spring steel of suitable configuration. Finally, as shown in FIG. 3, one of the sets of spacer mean blocks 17A–17D is made relatively larger in diameter, or cross section, than the other respective blocks 18A–18D in this form of the invention. This arrangement accommodates, and more uniformly distributes the greater torsion forces applied to the outer blocks by the larger canisters (14–15) in engagement with the outermost blocks 17A–17D. Thus, the localized mechanical stressing of the surfaces of the canisters adjacent to the blocks is minimized to reduce the risk of stress corrosion cracking, while at the same time minimizing the overall weight of the spacer means. Similarly, it should be apparent that further alternative arrangements of spacer means can be used in other embodiments of the invention in order to space the respective juxtaposed pairs of canisters from one another in various desirable configurations.

It should be obvious that in the type of container 1" shown in FIG. 3 most of the space between the respective juxtaposed pairs of canisters 14–15 and 15–16 is not filled with the blocks (or other similar articulated spacer means that may be used). Consequently, some of the corrosion inhibiting effect that is an inherent feature of the particulate type spacer means discussed above with reference to FIGS. 1 and 2 will be absent from such a configuration of the invention; however, as will be understood from an analysis of the following test data on containers made containing such void spaces between the respective pairs of juxtaposed canisters, the multiple surface effect provided by the plurality of canisters used is still operable to form a container that has a very long term corrosion resistant life.

Finally, reference is made to FIG. 4 to describe the features of an embodiment of the invention which is particularly adaptable for use in storing high level radioactive waste materials for very long time periods, while isolating those materials from exposure to corrosive agents in their ambient, as a consequence of corrosion occurring through all of the walls of the respective plurality of canisters making up the container. FIG. 4 shows a container 1C comprising a plurality of sealed canisters 20, 21 and 22. In this form of the invention, each of the canisters 20–22 is formed of a generally cylindrically shaped central portion (20A, 21A and 22A), and has two integral domes (20A'–20B, 21A'–21B, and 22A'–22B) affixed in sealing relationship to the respective opposite ends of the central portions of the canisters, as shown. Each of the canisters 20–22 is made of stainless steel and has walls of generally uniform thickness throughout the central portions and the dome portions thereof. However, the wall thickness of the outer canister 20 is made about twice as thick as the wall thicknesses of either of the two inner canisters 21 and 22. The wall thicknesses of the inner canisters are about equal to one another in the depicted embodiment, but as pointed out above, in given configurations of the invention other desirable wall thicknesses for the respective canisters may be utilized without departing from the scope of the invention.

The innermost canister 22 contains a body of radwaste material 23 that may be of any suitable form, or that may constitute a body of toxic material, or a mixture or solution of materials that is not necessarily radioactive. A characteristic feature of this embodiment of the invention is that only the central portions 20A, 21A and 22A of the respective canisters are directly supported by granular carbon spacer means 24 and 25. The spacer means 24 and 25 are arranged in bands 24A and 25A of particulate material. Each of the bands is made of a preselected desired axial width, as shown, and is positioned around desired predetermined portions (20A, 21A and 22A) of the respective canisters, so that only these predetermined portions of the respective canisters are mechanically supported to space each canister from a juxtaposed canister. Accordingly, it will be apparent that the transmission of mechanical stressing forces from the outer canister 20 to the inner canisters 21 and 22 is essentially limited to those predetermined central portions 21A and 22A of the inner canisters. Such an arrangement is particularly desirable in preventing the formation of stress cracking on the remaining outer surface portions of those two inner canisters. It is known that such stress cracking is effective to create small interstices that accelerate the rate of corrosion of a surface, when it is exposed to a corrosive agent. Thus, by isolating the major portions of the surfaces of the inner canisters 21 and 22 from such mechanical stresses, i.e., all of those canister surfaces except the limited predetermined area thereof which is in direct contact with the bands of particulate carbon spacer means 24 and 25, the major surfaces of the inner canisters 21 and 22 are protected from such stress corrosion cracking effects.

It should be apparent that alternative arrangements of spacer means (24 and 25) can be used to achieve the desired reduction of stress corrosion cracking in the surfaces of the inner canisters 21 and 22. For example, the use of spaced blocks such as those shown in FIG. 3, or utilization of an orientation of the container 1C, such that it would be positioned vertically, rather than with its longitudinal axis in a generally horizontal plane, as illustrated. Such a vertical orientation would make it feasible to dispose the spacer means separating the respective canisters around only their lower portions, for example, as shown in FIG. 1.

Similarly, while the preferred embodiment of the container 1C shown in FIG. 4 is arranged so that the respective spaces between the canisters 20–22 are essentially uniform, and about equal in radial and axial thickness, in alternative arrangements of such a container (1C) according to the teachings of the present invention, the respective spaces between the juxtaposed pairs of canisters (20–21 and 21–22) can be made so that there is a substantial difference in the spacing between the pairs of canisters, or between various areas of such intervening spaces. For example, it may be desirable in certain applications of the invention to provide a greater spacing between the respective canisters at their vertically lowermost ends, so that any liquid contaminants or corrosion-enhancing liquids that might penetrate the outer canisters will be collected in this relatively thicker spacing area, and thereby be prevented it for an extended period of time from coming into contact with the inner canisters. Such an arrangement would be particularly desirable in those cases where the spaces between the respective canisters is not completely filled (as is the case in the embodiment shown in FIG. 4) with a particulate or granular spacer means. In those embodiments where the spaces between the respective canisters is completely filled with a liquid flow inhibiting particulate or granular material, it is less important to provide a greater spacing between the respective canisters at the lowermost portions thereof, where gravity would tend to force the initially penetrating corrosive liquids or other materials to collect.

Regardless of the particular relative spacing between the respective canisters, it should be recognized that the width of the particulate bands of spacer material 24 and 25 should be such that the bands 24A and 25A of such material are effective to prevent the canisters 20–22 from moving relative to one another. Thus, in the illustrated embodiment, the band 24A and 25A of particulate carbon are made to have respective axial widths of about 1 ft., while the average axial length of the canisters 20–22 is about 3 ft. in length. It should also be understood that various suitable conventional methods may be used to form the bands 24A and 25A of particulate carbon material. However, in the illustrated embodiment, the respective bands 24A and 25A of carbon material are pressed in a suitable conventional mold (not shown) to form the bands in a desired configuration having essentially the desired respective radial and axial thicknesses to enable the bands to be pressed into operating position around the canisters 22 and 21, before the respective outer surrounding canisters have their domes sealed onto them, by welding or other suitable techniques. As mentioned above with reference to the embodiment shown in FIG. 2, the welds or other suitable sealing means used to close the respective canisters 20–22 in FIG. 4, should be polished or otherwise suitably finished to prevent the formation of undesirable discontinuities in the outer surfaces of the canisters. It should also be apparent that in practicing the invention various other conventional corrosion resistant coatings may be applied to the outermost surface of the outer canister 20 in order to maximize the corrosion resistant effect of that outer canister. For example, conventional epoxy or varnish materials may be applied to the outer canister before it is placed in a long term repository. Care should be taken in selecting such corrosion resistant materials to avoid the possible formation of electrolytic cell activity between that material and the material used in making the outermost canister (20).

Finally, it will be recognized that while the relatively sharp angular discontinuities of the cylinders shown in the container 1 of FIG. 1, or of the generally rectangular canisters of the container 1'' shown in FIG. 3, are suitable for certain long term, corrosion resistant storage applications of the invention, it is desirable in the most preferred embodiments to make canister configurations of substantially smooth uniform outer surface configurations such as those shown by the spherical canisters of FIG. 2, or by the dome shaped, seamless pipe configurations shown in the embodiment of FIG. 4, in order to maximize the corrosion resistant life of the respective containers.

In considering the design and construction of various suitable combinations of the disclosed characteristic features of the invention, in order to produce a container that is particularly desirable for a given application, it is necessary to recognize that any resultant container must withstand a variety of different tests in order to satisfy the long term corrosion resistant requirements for safely storing high level radwaste materials in suitable repositories. For example, such containers must have radiation stability, be suitably corrosion resistant in both leak tests and emersion stability tests, and should have suitable structural strength, in terms of compression to enable them to withstand the forces to which such containers may be subjected in a land-fill repository. The containers must have suitable puncture resistance, and be capable of withstanding drop or impact resistance tests, (particularly in terms of maintaining the desired spacing between the respective canisters of the container). Furthermore, such containers should be made to have characteristics that enable them to be thermally stable over an anticipated temperature range of about +40° C., and to be stable during relatively rapid thermal cycling, which may occur in various desert repository areas where the average daily temperature can undergo wide ranging extremes. The containers must, of course, resist long term biodegradation effects that may be applied to them from the earth or other environment present in the long term storage repository in which the containers are to be deposited in use.

An inherent difficulty in thus suitably testing long term storage containers is to develop adequate short range testing that produces results which can be safely extrapolated to the thousand-year periods contemplated for safe storage by the regulations mentioned during the background discussion presented above. To accomplish such test objectives, it is common practice to use well-known corrosion agents in systems that apply corrosion enhancing temperatures to tested containers in order to determine their resistance to corrosion. Some samples of the tests that were performed on various embodiments of prototypes of the present invention are presented below, in order to further teach the characteristic features of the invention, and to help demonstrate its advantages.

TEST RESULTS ON PROTOTYPES

The test results described below were obtained using well known rapid-corrosion systems to illustrate the improvements obtainable with containers constructed according to the principles of the subject invention. Each prototype container tested consisted essentially of a plurality of canisters in the form of generally cylindrical tubes that were each machined to have uniform wall thicknesses and that had a disk of the same material as that used in the walls of the canisters welded over their lower ends to seal those ends against leakage. The top of the respective tubes were enclosed with a suitable block of Teflon material in which small vent holes were provided. Thus, it will be understood that the prototypes tested were effective to demonstrate the corrosion inhibiting effect of a plurality of sequentially corroded canister surfaces, each spaced from one another with the various spacer means described below in the respective test descriptions; however, the upper ends of the tubes, or canisters, were not completely sealed. Moreover, the upper ends of the tubes were closed with a material that was different than that used in the body of the canisters to which the corroding agents were applied. These tests provided test results that enable a reasonable extrapolation to be made of the anticipated life that is obtainable with such plural-canister, suitably spaced and supported arrangements to fabricate a container according to the present invention.

As shown by the following test set-up data, canisters of both aluminum and stainless steel were tested in some of the testing on prototypes of the invention. Specifically, 410 Stainless Steel and 6061-T6 aluminum were used in the tests of the prototypes. The tests on the aluminum prototypes were conducted in a 1 M (Molar) $NH_4Cl$ and 0.2 M $NH_4NO_3$ solution that was maintained at about 50° C. to provide optimum corrosion conditions for a series of multiple canister corrosion tests. To provide an accelerated optimum corrosion rate for the tested 410 SS multiple canisters, a solution of 0.2 M $FeCl_3.6H_2O$, maintained at about 70° C. was provided for such an optimum corrosion test. Test A (results shown below) used three sets of multiple aluminum canisters of three canisters each. Each set of canisters was suspended in a single battery jar that was about 10 inches square and that was partially submerged in a heated oil bath. The above-mentioned Teflon cover plate was fabricated to suspend the sets of aluminum canisters or disk-covered tubes, during corrosion. A water cooled reflux condenser was fitted into the Teflon cover to minimize solution evaporation. In test A, each set of three aluminum canisters differed from the other sets by the type of spacer means, or filler, disposed in the generally cylindrical spaces between the respective juxtaposed pairs of canisters. In one set of canisters, the space between juxtaposed canisters was left essentially void, i.e., it was not filled with a granular or other type of spacer means. A second set of the canisters was provided with spacer means in the form of fine granular sand or $SiO_2$, while the remaining set of canisters had the spaces between the canisters essentially filled with borosilicate glass beads that were about 4 millimeters in diameter. The following general parameters were used for Test A:

| | |
|---|---|
| Temperature | 50° C. + 3° |
| Corroding medium | 7200 mL 1 M $NH_4Cl$, 0.2 M $NH_4NO_3$ |
| Test specimen: | |
| Material | Aluminum 6061-T6 |
| Size | 1 in. × 9 in., 1.5 in. × 10 in., 2 in. × 11 in. (nominal) |
| Wall thickness | 0.030 in. |
| Finish | as received |
| Degreased in alconox, methyl alcohol, acetone | |

A second test, Test B, was performed using a single multiple-canister container made of the same type of aluminum canisters, with Teflon-sealed tops, set in a 10 in. square battery jar. In Test B, the space between the juxtaposed pairs of canisters was left essentially void, i.e., filled with air, and the same parameters stated above with respect to Test A were used, except that the corrosion inducing solution volume was about 7600 milliliters.

A third test, Test C, was conducted using two battery jars. Each of those battery jars had a separate multiple aluminum canister container, of the type described above, positioned in it. The spaces between the juxtaposed pairs of canisters in the aluminum-canister container of the first jar were left essentially void, i.e., air filled, while the spaces between the juxtaposed pairs of canisters in the second battery jar were each filled with borosilicate glass beads having a diameter of about 4 mm each. The parameters used in performing Test C were essentially identical to those used in performing Test A, except that the volume of corroding medium in each of the battery jars was about 7500 mL.

A fourth test, Test D, was performed on two multiple canister containers, each formed of canisters made of 410 Stainless Steel. In Test D the two canisters were positioned in separate 10 inch square battery jars. The first container had the spaces between its respective juxtaposed pairs of canisters essentially unfilled, i.e., filled by air or a void, while the spaces between the juxtaposed pairs of canisters in the second container were filled with a filler or spacer means comprising fine granular sand, $SiO_2$. The following test parameters were used in conducting Test D:

| | |
|---|---|
| Temperature | 70° C. + 3° |
| Corroding medium | 2000 mL 1 $FeCl_3.6H_2O$ |
| Test specimen: | |
| Material | 410 Stainless Steel |
| Size | ½ in. × 10 in., ¾ in. × 10.75 in., 1 in. × 11.5 in. |
| Wall thickness | 0.018 in. |
| Finish | as received |
| Degreased in alconox, methyl alcohol, acetone | |

In performing all of the tests indicated by the foregoing electrical continuity measurements were made between the component canisters in each container, or separately tested set of canisters, in order to determine when corrosion occurred. The results of the respective tests A–D are set forth below:

TEST A

| Canister Location | *Hours | Spacer (Filler) | *Hours | Spacer (Filler) | *Hours | Spacer (Filler) |
|---|---|---|---|---|---|---|
| Outer | 102 | Void | 102 | $SiO_2$ | 102 | Glass beads |
| Middle | 300 | Void | 1344 | $SiO_2$ | 2160[2] | Glass beads |
| Inner | 1368 | Void | 2160[1] | $SiO_2$ | 2160[2] | Glass beads |

[1]Dry salt corrosion at top - no corrosion in liquid.
[2]Did not corrode - test stopped at this point.

TEST B

| | | |
|---|---|---|
| Outer | 151 | Void |
| Middle | 246 | Void |
| Inner | 552 | Void |

TEST C

| | | | | |
|---|---|---|---|---|
| Outer | 190 | Void | 170 | Glass beads |
| Middle | 331 | Void | 373 | Glass beads |
| Inner | 335 | Void | 1023 | Glass beads |

TEST D

| | | | | |
|---|---|---|---|---|
| Outer | 24 | Void | 22 | $SiO_2$ |
| Middle | 132 | Void | 334 | $SiO_2$ |
| Inner | 245 | Void | 674[3] | |

[3]Test in progress - no corrosion observed.
*Duration between test starting date and through wall corrosion.

As can be seen from the foregoing test results, in some cases the voids between the respective canisters were sufficient, without the use of additional spacer means or fillers, to provide more than a factor of 10 in corrosion inhibiting effect, while sand and glass in some of the test cases (Test A and Test D) totally prevented corrosion over the time studied. In other test cases (Test D) the results indicate factors greater than 30 in inhibiting corrosion. While more extended test results, in terms of both the types of corrosion inducing materials used and in terms of the duration of the tests, would provide more complete data for anticipating the expected life of a container constructed according to the invention, the test results do establish the effective reduction to practice of the invention and its capability for affording the desired objectives specified above.

It will be recognized by those skilled in the art that long term corrosion resistant storage containers for isolating radioactive waste materials in suitable high level waste repositories can be made according to the invention by making various further modifications and alternative embodiments of the invention, thereby utilizing the characteristic principles of the invention disclosed herein. Accordingly, it is my intention to encompass within the following claims the true spirit and scope of the invention.

We claim:

1. A corrosion resistant, radioactive-waste-material-isolating, long-term storage container for isolating radioactive waste material in a high level waste repository comprising:

a plurality of at least three completely sealed corrosion resistant canisters of different relative sizes, said canisters being arranged with all of the smaller canisters encased within and completely surrounded by and sealed within the largest canister and with the smallest canister encased within all of the other canisters in said plurality of canisters, and spacer means disposed between juxtaposed pairs of said canisters, said spacer means being effective to space the canisters of each of said juxtaposed pairs from one another.

2. An invention as defined in claim 1 wherein each of said canisters is made of essentially the same kind of material, thereby to prevent electrolytic action from occurring between said juxtaposed pairs of canisters responsive to an electrolyte entering the spaces between them.

3. An invention as defined in claim 1 wherein said spacer means comprises densely packed particulate material that is arranged in separate batches that are positioned, respectively, between each of said juxtaposed pairs of canisters, said particulate material being effective to; inhibit free flow of liquids, inhibit diffusion of reactants from the juxtaposed surfaces of said canisters, inhibit removal of corrosion products from the juxtaposed surfaces of said canisters, and provide large surface areas for adsorbing reactants that penetrate the outer canisters.

4. An invention as defined in claim 3 wherein said batches of particulate material each substantially fill, respectively, one of the spaces between one of said juxtaposed pairs of canisters.

5. An invention as defined in claim 3 wherein said particulate material comprises particles of carbon.

6. An invention as defined in claim 3 wherein at least one of said batches of material comprises a material different from that in the other batches.

7. An invention as defined in claim 6 wherein at least one of said batches of material is sufficiently small so that it only partially fills the space between the pair of canisters juxtaposed therewith.

8. An invention as defined in claim 7 wherein said at least one batch substantially fills about half of the space between the pair of canisters juxtaposed therewith.

9. An invention as defined in claim 2 wherein each of said canisters has a substantially uniform wall thickness in the range of about 0.015 to 0.040 inch.

10. An invention as defined in claim 9 wherein each of said canisters has a substantially equal wall thickness.

11. An invention as defined in claim 10 wherein said plurality comprises at least three, and wherein each of said canisters is made of stainless steel and has a wall thickness of about 0.018 inch.

12. An invention as defined in claim 1 wherein said spacer means are made of essentially the same material as that used to make the respective canisters juxtaposed therewith.

13. An invention as defined in claim 1 wherein each of said canisters has a generally cylindrical central portion and two integral domes sealing the opposite ends of said central portion.

14. An invention as defined in claim 13 wherein the largest canister has a generally uniform wall thickness that is about at least twice as thick as the wall thickness of any of the other canisters in said plurality of canisters.

15. An invention as defined in claim 13 wherein said spacer means comprises a plurality of bands of particulate material, each of said bands of material being positioned around a predetermined portion of said canisters in juxtaposition therewith.

16. An invention as defined in claim 15 wherein each of said bands of material is positioned around the middle portion of one of said canisters, and wherein each of said bands of material is effective to prevent the canisters from moving relative to one another.

* * * * *